US007575412B2

(12) United States Patent
Seitz

(10) Patent No.: US 7,575,412 B2
(45) Date of Patent: Aug. 18, 2009

(54) ANTI-STALL CASING TREATMENT FOR TURBO COMPRESSORS

(75) Inventor: Peter Seitz, Eichenau (DE)

(73) Assignee: MTU Aero Engines GmbH, Munich (DE)

( * ) Notice: Subject to any disclaimer, the term of this patent is extended or adjusted under 35 U.S.C. 154(b) by 546 days.

(21) Appl. No.: 10/505,971

(22) PCT Filed: Feb. 5, 2003

(86) PCT No.: PCT/IB03/00371

§ 371 (c)(1),
(2), (4) Date: Mar. 30, 2006

(87) PCT Pub. No.: WO03/072949

PCT Pub. Date: Sep. 4, 2003

(65) Prior Publication Data

US 2008/0206040 A1 Aug. 28, 2008

(30) Foreign Application Priority Data

Feb. 28, 2002 (DE) ..... 2002/1688

(51) Int. Cl.
*F01D 25/24* (2006.01)

(52) U.S. Cl. ..... 415/58.5; 415/58.7

(58) Field of Classification Search ..... 415/57.4, 415/58.3, 58.4, 58.5, 58.7, 186, 220, 221
See application file for complete search history.

(56) References Cited

U.S. PATENT DOCUMENTS 3,189,260 A 6/1965 Ivanov
4,871,294 A * 10/1989 Ivanov et al. ..... 415/58.7
5,137,419 A * 8/1992 Waterman ..... 415/170.1
5,282,718 A 2/1994 Koff et al.
5,308,225 A * 5/1994 Koff et al. ..... 415/57.3

(Continued)

FOREIGN PATENT DOCUMENTS

EP 0 719 908 A1 7/1996

(Continued)

OTHER PUBLICATIONS

Merriam-Webster Online Dictionary, "recess," accessed Apr. 6, 2009.*

(Continued)

*Primary Examiner*—Richard Edgar
(74) *Attorney, Agent, or Firm*—Crowell & Moring LLP

(57) ABSTRACT

A compressor includes a casing defining a generally cylindrical flow passage, a rotor carrying at least one set of rotor blades, at least one set of stator blades, and anti-stall casing treatment. The casing treatment includes an annular recess in the casing for removing low momentum flow adjacent the tips of the rotor blades, and returning the flow to the generally cylindrical flow passage upstream of the point of removal. A plurality of curved guide vanes are located within the annular recess so as to define an annular inlet downstream of the vanes and/or an annular outlet upstream of the vanes. Each guide vane projects radially inwardly from the casing towards a free end which is exposed at or near the mouth of the recess to define a series of curved channels within the recess adjacent the annular inlet and/or the annular outlet.

68 Claims, 4 Drawing Sheets

U.S. PATENT DOCUMENTS 5,431,533 A * 7/1995 Hobbs ..... 415/58.7
5,562,404 A * 10/1996 Koff et al. ..... 415/57.4
5,762,470 A 6/1998 Gelmedov et al.
6,234,747 B1 * 5/2001 Mielke et al. ..... 415/119

FOREIGN PATENT DOCUMENTS

EP 0 754 864 A1 1/1997
EP 1 008 758 A2 6/2000

OTHER PUBLICATIONS

Merriam-Webster Online Dictionary, "chamber," accessed Apr. 6, 2009.*

* cited by examiner

ANTI-STALL CASING TREATMENT FOR TURBO COMPRESSORS

This application claims the priority of German application no. 2002/1688, filed Feb. 28, 2002, and PCT International Patent Application No. PCT/IB03/00371, filed Feb. 5, 2003, the disclosure of which is expressly incorporated by reference herein.

BACKGROUND OF THE INVENTION

This invention relates to compressors, and more specifically to an anti-stall casing treatment arrangement for turbo-compressors.

Turbo-compressors of the type used in aero-engines, industrial gas turbines, gas compression systems and pumps all have an aerodynamic limit of stable operation. Beyond this limit, a condition known as rotating stall occurs in which the smooth flow of gas through the compressor is disturbed by a rapidly rotating annulus of pressurised gas about the tips of one of more stages of the compressor blades. Where a complete breakdown of flow occurs through all stages of the compressor so as to stall all stages of the blades, the compressor will surge.

Turbo-compressors generally are designed to have a safety margin between the airflow and pressure ratio for normal operation and the airflow and pressure ratio at which stall will occur. It is desirable to raise the stall line to a higher pressure ratio for a given engine operation because this allows for an increase in the stall margin and/or an increase in the operating pressure ratio, and hence the performance, of the compressor.

Significant improvements in stall margin can be achieved by treating the compressor casing adjacent the tips of the compressor rotor blades. However, in conventional anti-stall casing treatment arrangements, which usually include slots, chambers and grooves in the compressor casing, improvements in the stall margin often are associated with a loss of compressor efficiency and mass flow at high speeds.

A known casing treatment is disclosed in a paper from The School of Mechanical Engineering, Cranfield Institute of Technology in Great Britain entitled "Application of Recess Vaned Casing Treatment to Axial Flow Compressors", February 1998, A. R. Aziman et al; in an ASME paper in The Journal of Fluid Engineering Vol. 109, May 1987, entitled "Improvement of Unstable Characteristics of an Axial Flow Fan by Air-Separator Equipment", Y. Mijake et al; and in U.S. Pat. No. 3,189,260. These publications disclose a mechanism including a recess for collecting rotating stall cells in post-stall operation. Since rotating stall extends a significant distance upstream of the rotor blades, it would appear that the recess has to be relatively large in order to be effective. While this kind of casing treatment is suitable for low-speed applications such as, for example, industrial fans and compressors, it is not suitable for aircraft applications where weight and space restrictions do not allow for a relatively large recess in the outer casing at the inlet of the engine or in front of a compressor.

A further casing treatment is disclosed in U.S. Pat. No. 5,762,470. This patent describes an annular chamber in the casing adjacent the tips of the rotor blades which communicates with the main flow passage in the compressor via a series of circumferentially spaced-apart slots. In use, pressure differences between the main flow passage and the annular chamber cause air to flow through the slots disposed about the rotor blades into the annular chamber and back into the flow path upstream of the rotor blades. A disadvantage associated with this particular type of casing treatment is that it requires a special coating on the ribs between the slots to protect these ribs from damage during blade contact. Since the width of the ribs and slots often is too small for adequate coating adhesion, the coating tends to fall away during compressor operation. On the other hand, if the coating is not applied, it is necessary to increase the tip gap significantly to prevent tip rub during operation, and this adversely affects the efficiency of the compressor. A further drawback associated with this type of casing treatment is that, for effective operation, it is necessary to have a relatively large annular chamber in the outer casing. As mentioned above, this is problematic for certain applications such as aero-engine compressors. Also, the relatively thin ribs between the slots are sensitive to resonance caused by the interaction of the rotor blades with the ribs, and accordingly the application of this treatment is restricted.

U.S. Pat. No. 5,282,718 discloses casing treatment in the form of an annular inlet located in proximity to the trailing edges of compressor rotor blades and leading to a plurality of anti-swirl vanes which are circumferentially spaced apart within an annular cavity, and an annular outlet leading back to the main flow path at a region adjacent the leading edges of the rotor blades. In this design, flow which is on the verge of separating from the blade tips is sucked into the annular chamber via the inlet and passes upstream through the anti-swirl vanes primarily by means of the axial pressure gradient across the annular chamber. A drawback associated with this type of casing treatment is that, generally, the improvement in stall margin leads to a reduction in compressor efficiency and mass flow.

It is an object of the present invention to provide an alternative casing treatment for a compressor which is compact, relatively inexpensive to manufacture, and which improves the operating range of the compressor without adversely affecting the efficiency of the compressor.

For the purposes of this specification, the term "axial" refers to a direction parallel to the longitudinal axis of the compressor casing, the term "cross-sectional" refers to a direction perpendicular to the longitudinal axis of the compressor casing, and the term "radial" refers to a direction extending radially from or towards the longitudinal axis of the compressor casing.

SUMMARY OF THE INVENTION

According to a first aspect of the invention there is provided a compressor including: a casing which defines a generally cylindrical flow passage; a rotor carrying at least one set of rotor blades;

at least one set of stator blades; and casing treatment including:

an annular recess in the casing for removing low momentum flow adjacent the tips of the rotor blades, in use, and returning the flow to the generally cylindrical flow passage upstream of the point of removal; and a plurality of curved guide vanes located within the annular recess so as to define an annular inlet downstream of the vanes and/or an annular outlet upstream of the vanes, each guide vane projecting radially inwardly from the casing towards a free end which is exposed at or near the mouth of the recess to define a series of curved channels within the recess adjacent the annular inlet and/or the annular outlet.

In a preferred embodiment of the invention, the rear wall of the annular recess and the front wall of this recess are inclined at an angle, typically between 30° and 90°, relative to the longitudinal axis of the casing.

The inclination of the rear wall relative to the casing longitudinal axis may differ from that of the front wall.

Preferably, the guide vanes are inclined in the radial direction at an angle between 10° and 90°. In this case, the inclination of the guide vanes relative to the radial direction may vary along the height and/or the length of these vanes.

In one embodiment of the invention, the ratio between the guide vane radial projection height, i.e. the height of the guide vanes in the radial direction, and the radial depth of the annular recess is less than 1.0. In other words, the free ends of the guide vanes terminate short of the casing adjacent the annular recess so as to locate outside the casing flow passage.

The ratio between the guide vane radial projection height and the radial depth of the annular recess may vary along the axial length of the guide vanes.

Ideally, the porosity of the annular recess, i.e. the ratio between the volume of the guide vanes and the total volume of the recess, is greater than 0.5. Typically, the ratio between the cross-sectional width of the channel between adjacent guide vanes and the cross-sectional pitch of the guide vanes is between 0.3 and 1.0, and may vary along the radial projection height and/or the axial length of the guide vanes.

In one arrangement, the ratio between the vane radial projection height and the overall axial width of the annular recess is between 0.2 and 1.0. Preferably, the axial midpoint of the annular recess lies upstream of the rotor blade axial chord midpoint in the blade tip region.

The ratio between the axial width of the annular recess and the rotor blade axial chord ideally is between 0.4 and 1.0.

In one embodiment of the invention, the compressor includes an annular recess and guide vanes, similar to the recess and vanes described above, in a rotor hub adjacent the stator blades.

The compressor may be a single-stage or a multi-stage compressor designed for axial flow, diagonal flow or radial flow.

According to a second aspect of the invention there is provided a casing insert for a compressor of the type including a casing which defines a generally cylindrical flow passage, a rotor carrying at least one set of rotor blades, and at least one set of stator blades, the casing insert being connectable to the compressor casing adjacent the rotor blades and defining casing treatment which includes:

an annular recess for removing low momentum flow adjacent the tips of the rotor blades, in use, and returning the flow to the generally cylindrical flow passage upstream of the point of removal; and a plurality of curved guide vanes located within the annular recess so as to define an annular inlet downstream of the vanes and/or an annular outlet upstream of the vanes, each guide vane projecting radially inwardly from the casing insert towards a free end which is exposed at or near the mouth of the recess to define a series of curved channels within the recess adjacent the annular inlet and/or the annular outlet.

Other objects, advantages and novel features of the present invention will become apparent from the following detailed description of the invention when considered in conjunction with the accompanying drawings.

BRIEF DESCRIPTION OF THE DRAWINGS

The invention will now be described in more detail, by way of example only, with reference to the accompanying drawings in which.

DESCRIPTION OF THE PREFERRED EMBODIMENTS

Figure 1:
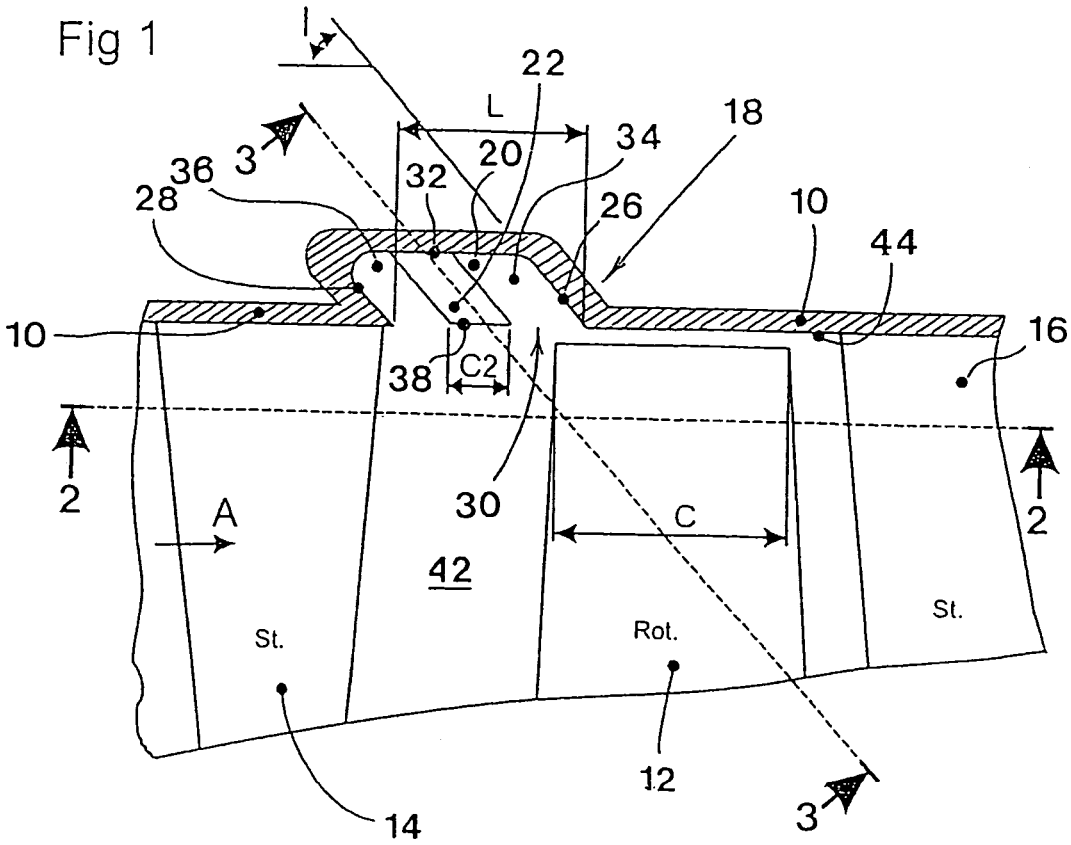
FIG. 1 shows an axial cross-sectional view of a portion of a turbo-compressor according to an embodiment of the present invention.

FIG. 1 of the drawings illustrates a portion of a casing 10 of a multi-stage, axial flow turbo-compressor, and one of a series of rotor blades 12 on a rotor shaft (not illustrated) extending centrally through the casing. A series of stator blades 14 and 16 are secured to the casing upstream and downstream of the rotor blades respectively, as shown. To delay the onset of stall conditions at the tips of the rotor blades, the casing 10 includes an anti-stall casing treatment arrangement designated generally with the reference numeral 18.

Figure 2:
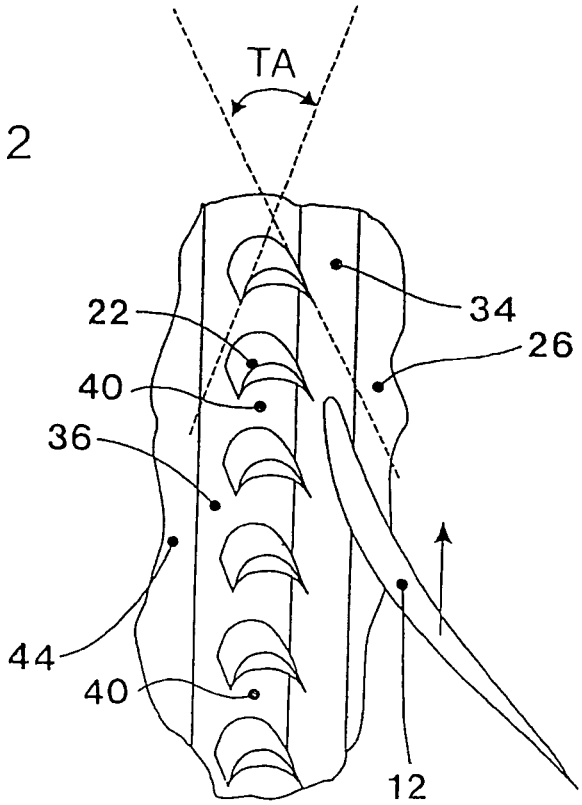
FIG. 2 shows a cross-sectional view along the line 2-2 in FIG. 1.
Figure 3:
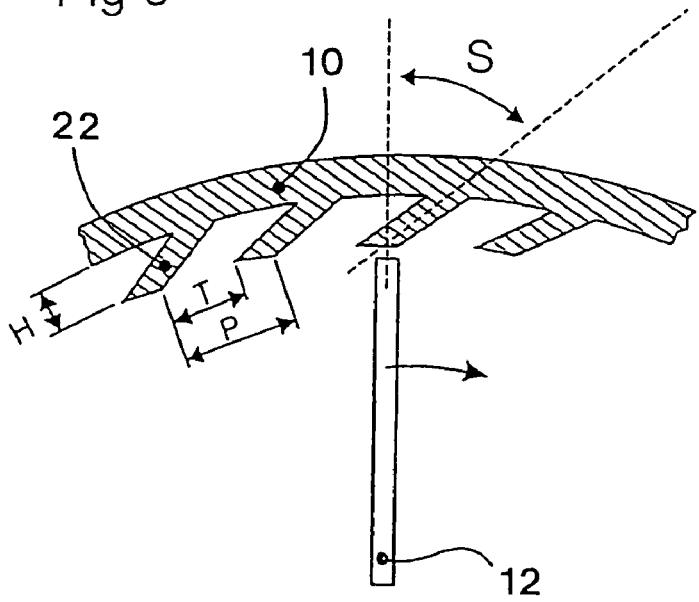
FIG. 3 shows a cross-sectional view along the line 3-3 in FIG. 1.

In this embodiment of the invention, the arrangement 18 comprises an annular recess 20 in the casing 10 and a plurality of spaced-apart guide vanes 22 within the recess. With reference also to FIGS. 2 and 3 of the accompanying drawings, the recess 20 is formed by a rear wall 26, a front wall 28 which together with the rear wall defines a mouth 30 leading into the recess 20, and an outer wall 32 between the rear wall and the front wall. Each guide vane 22 is curved (see FIG. 2), has an axial length C2 and is located within the recess 20 so as to define an annular inlet 34 and an annular outlet 36 upstream of the inlet 34. The guide vanes 22 are seen in FIG. 1 to project radially inwardly from the outer wall 32 to free ends 38 at the mouth of the recess 20 to form a plurality of curved channels 40 within the annular recess. The inlet 34, the outlet 36 and the curved channels 40 all communicate with a generally cylindrical flow passage 42 defined by the casing 10, as shown most clearly in FIG. 2 of the drawings.

In the illustrated embodiment, the rear wall 26 and the front wall 28 are inclined at an angle I with respect to the longitudinal axis of the casing 10, where I typically lies between 30° and 90°. The guide vanes 22 are also inclined relative to the casing longitudinal axis, as shown in FIG. 1, and are inclined in the radial direction with a pitch P and tip separation T, as illustrated in FIG. 3. The skew angle S of the vanes 22 relative to the radial direction, which may vary along both the height H and the curved length of the guide vanes 22, lies between 10° and 90°.

To optimise the effectiveness of the casing treatment according to the present invention, the ratio between the cross-sectional width of the channel between adjacent guide vanes and the cross-sectional pitch of the guide vanes lies between 0.3 and 1.0; the ratio between the vane radial projection height H and the overall axial width L of the annular recess lies between 0.2 and 1.0; the ratio between the axial width of the annular recess and the rotor blade axial chord C lies between 0.4 and 1.0; and the turning angle TA of the guide vanes 22, which may vary along the height H of the vanes, lies between 15° and 1750.

In practice, low momentum flow near the casing 10, which can eventually stall the compressor, is drawn into the recess 20 via the inlet 34, directed along the curved channels 40 where swirl in the flow is reduced, and reintroduced into the mainstream flow at a higher velocity via the outlet 36, while strong axial flow is retained within the cylindrical flow passage 42 as mainstream flow.

In the embodiment illustrated in FIGS. 1 to 3, the casing treatment is designed so that the low momentum flow entering the recess 20 is at its minimum when the compressor operates at its design point. At the aerodynamic design point of the compressor, the mass flow which enters the recess 34 is typically of the same order as the flow which leaks over the rotor blade tips in a compressor without the casing treatment arrangement. However, when the compressor reaches its maximum pressure rise, i.e. the stall point of the compressor, and the mainstream flow A breaks down in the outer region of the rotor blades near the inner wall 44 of the casing 10, the flow separating from the mainstream flow enters the annular recess 20 via the inlet 34 and is returned to the mainstream flow at a higher velocity via the outlet 36. At this point, the flow through the recess 20 is at a maximum and serves to stabilise the compressor allowing it to operate at a higher pressure rise.

When the compressor operates at a rotational speed higher than the design speed, the flow enters the recess 20 via the outlet 36 and exits via the inlet 34 to increase the choke margin of the compressor. Conversely, when the compressor is operating at a rotational speed below the design speed, the flow through the recess 20 is similar to that of the compressor when throttled to operate near its stall point, under which condition the mass flow entering the inlet 34 from the rotor blade tip gap is intensified.

Accordingly, although the casing treatment of the invention intensifies the recirculation effect both at low speeds and at design speeds close to stall, at the compressor design point, i.e. at maximum efficiency, the casing treatment minimises the re-circulation effect so as to minimise losses in efficiency.

Figure 4:
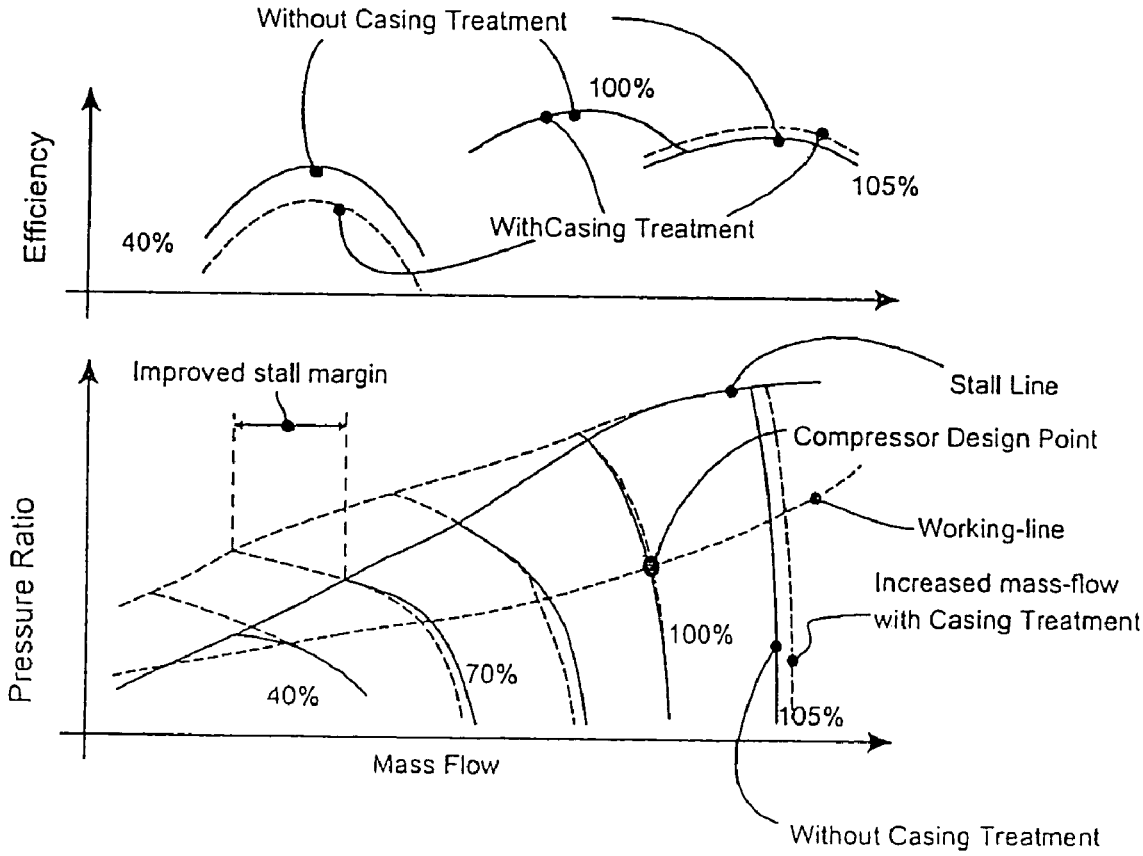
FIG. 4 is a graphical representation of the relationship between the mass flow on the one hand and the efficiency and pressure ratio on the other hand of a compressor including casing treatment according to the present invention as opposed to a compressor without casing treatment.

FIG. 4 illustrates the effects of the casing treatment arrangement of the invention on compressor performance, and demonstrates the improvements which can be attained in generic compressor characteristics with the compressor casing treatment arrangement 18.

Two further embodiments of the casing treatment according to the invention are illustrated in FIGS. 5 to 8 of the accompanying drawings. In the FIGS. 5 and 6 embodiment, an anti-stall casing treatment arrangement 118 comprises an annular recess 120 in the casing 110 and a plurality of spaced-apart guide vanes 122 within the recess. Each guide vane 122 is curved (see FIG. 6) and is located within the recess 120 so as to define an annular inlet 134 and a plurality of outlets 136 upstream of the inlet 134 between the adjacent vanes 122. As in the case of the previous embodiment, the guide vanes 122 project inwardly from an outer wall 132 to free ends 138 at the mouth 130 of the recess 120 to form a plurality of curved channels 140 within the recess. The inlet 134, the outlets 136 and the curved channels 140 all communicate with a generally cylindrical flow passage 142 defined by the casing 10.

Figure 5:
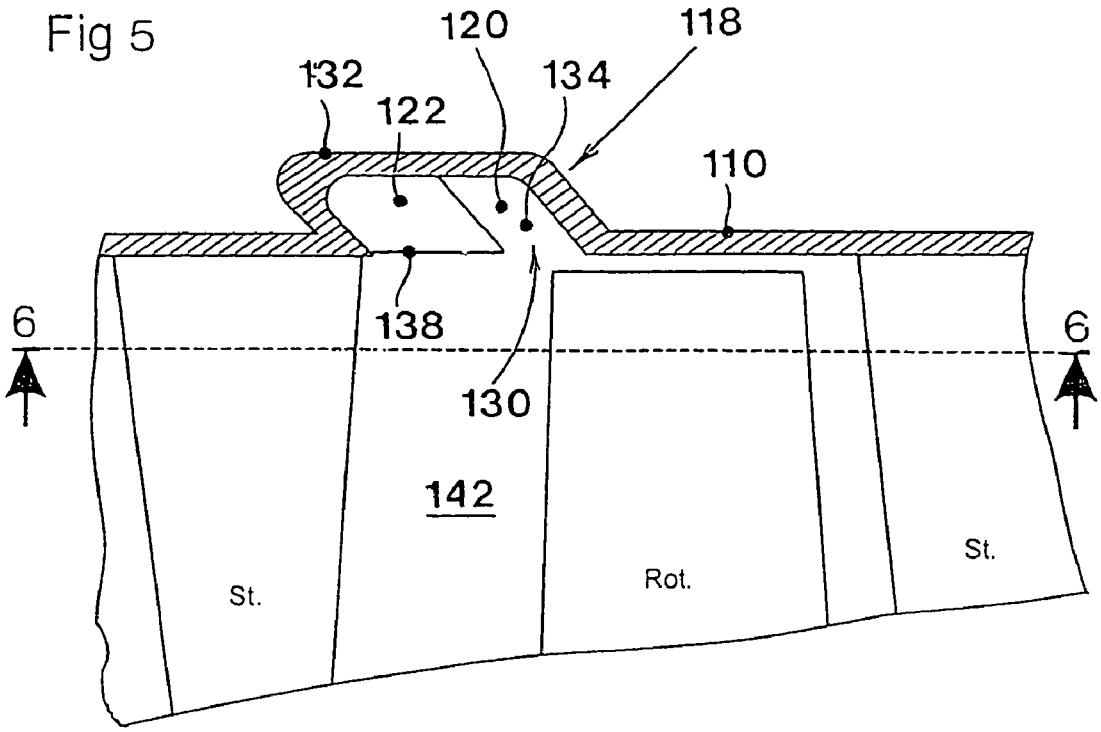
FIG. 5 shows an axial cross-sectional view of a portion of a turbo-compressor according to another embodiment of the invention.

In this embodiment of the invention, the free ends 138 of the guide vanes 122 terminate short of the casing 110 adjacent the annular recess 120, as shown most clearly in FIG. 5. In this way, the free ends 138 are slightly recessed relative to the casing 110 and hence lie outside the flow passage 142 defined by the casing. This is advantageous in certain applications, for example where relatively hard materials are used, since it prevents blade rub from transient rotor blade movements, and thereby avoids the need for special soft coatings on the guide vanes 122, which tend to be relatively expensive, difficult to apply and high in maintenance.

Figure 6:
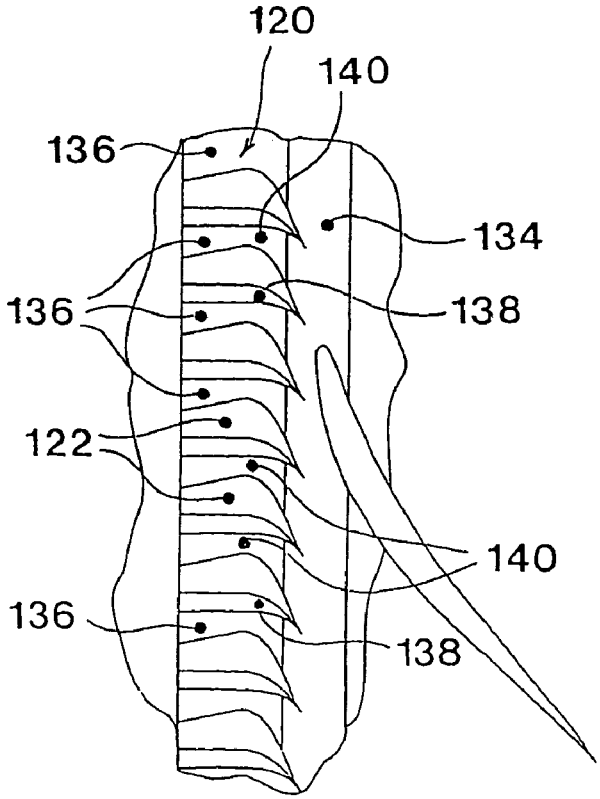
FIG. 6 shows a cross-sectional view along the line 6-6 in FIG. 5.
Figure 7:
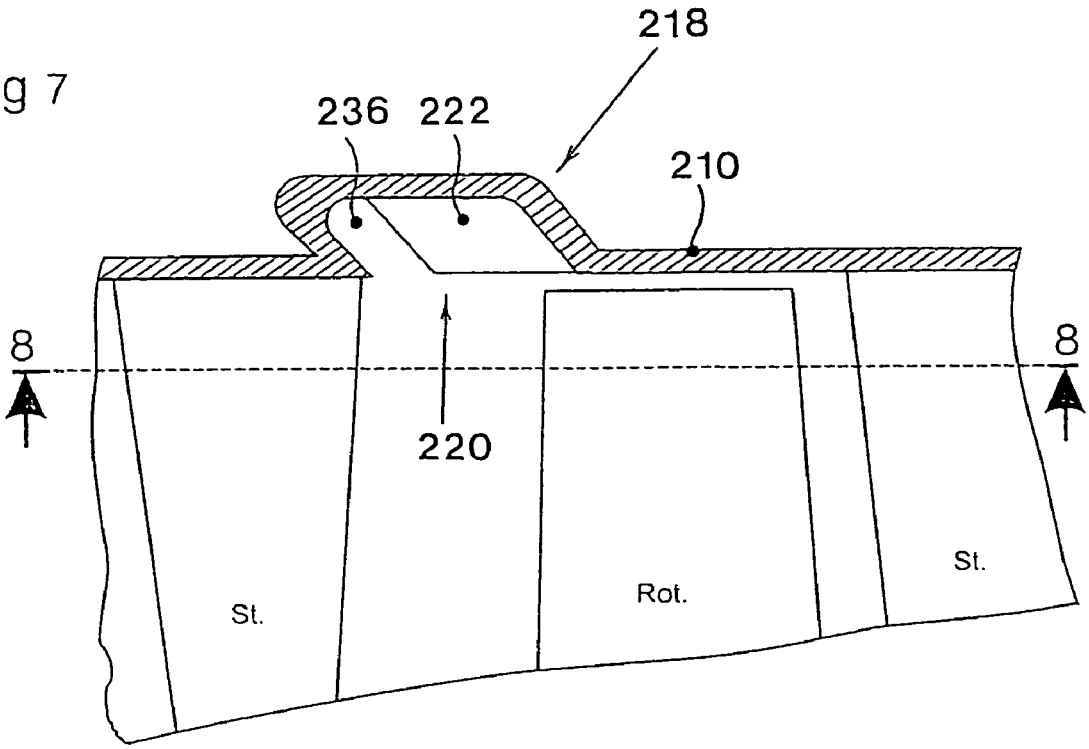
FIG. 7 shows an axial cross-sectional view of a portion of a turbo-compressor according to yet another embodiment of the invention.
Figure 8:
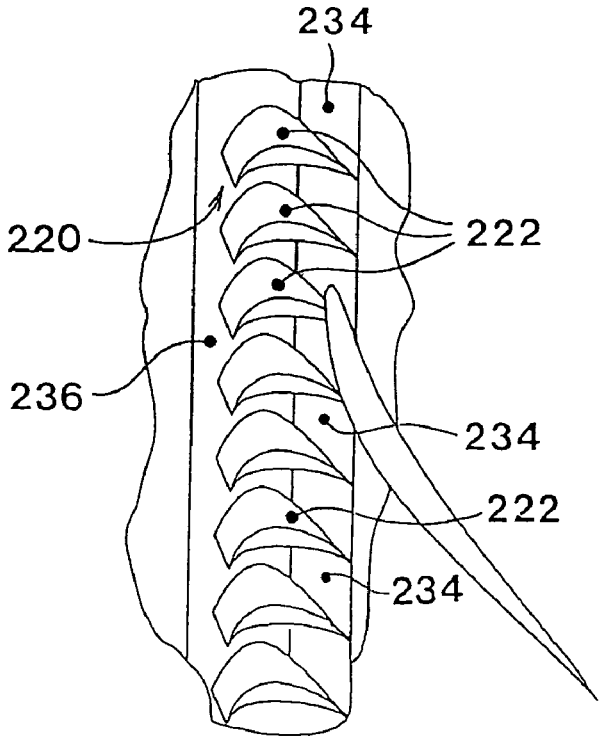
FIG. 8 shows a cross-sectional view along the line 8-8 in FIG. 7.

The FIGS. 7 and 8 embodiment differs from the FIGS. 5 and 6 embodiment in that the anti-stall casing treatment arrangement 218 comprises an annular recess 220 in the casing 210 and a plurality of curved, spaced-apart guide vanes 222 within the recess 220 which define a plurality of inlets 234 between the vanes 222 and an annular outlet 236 upstream of the inlets 234. Also, unlike the FIGS. 5 and 6 embodiment, the free ends of the guide vanes 222 are not recessed relative to the casing 210 adjacent the annular recess 220.

In a non-illustrated embodiment of the invention, the hub of the rotor includes an arrangement similar to that described above with reference to FIGS. 1 to 3 of the accompanying drawings adjacent stator blades.

Although the casing treatment arrangements 18, 118 and 218 have been described above as integral parts of the casings 10, 110 and 210, it will be appreciated that the casing treatment could be formed in an annular insert which is attachable to two lengths of the casing so as to be sandwiched between the two lengths of casing adjacent the rotor blades of the compressor. Also, although the invention has been described with reference to compressors including upstream stator blades, it will be understood that the casing treatment may also be applied to compressors which do not include these stator blades.

One advantage of the casing treatment according to the present invention is that it improves the operating range of the compressor without significant losses in compressor efficiency. Furthermore, since the casing treatment of the invention is effective in increasing stall margin while retaining efficiency, it is not sensitive to surface roughness and geometric tolerances, and hence provides a relatively inexpensive replacement for stall control devices currently used in compressors, such as variable stator vanes and the associated actuators and control algorithms. In addition, since the guide vanes in the casing treatment may be recessed to avoid blade rub, there is no need for special coatings which tend to be relatively expensive, and difficult to apply and maintain. Another advantage of the casing treatment according to the present invention is that it is relatively compact and hence suitable for aircraft applications. Also, at very high speeds of operation, for example at take off in an aero-engine, the casing treatment improves the choke margin and the efficiency of the compressor, as shown in FIG. 4 of the accompanying drawings.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A compressor including:

a casing which defines a generally cylindrical flow passage; a rotor carrying at least one set of rotor blades;

at least one set of stator blades; and casing treatment including:

an annular recess in the casing for removing low momentum flow adjacent the tips of the rotor blades, in use, and returning the flow to the generally cylindrical flow passage upstream of the point of removal; and a plurality of curved guide vanes located within the annular recess so as to define an annular inlet downstream of the vanes and/or an annular outlet upstream of the vanes, each guide vane projecting radially inwardly from the casing towards a free end which is exposed at or near the mouth of the recess to define a series of curved channels within the recess adjacent the annular inlet and/or the annular outlet.

2. A compressor according to claim 1, wherein a rear wall of the annular recess and a front wall of this recess are inclined at an angle relative to the longitudinal axis of the casing.

3. A compressor according to claim 2, wherein the angle of inclination of the rear wall and the front wall relative to the longitudinal axis of the casing is between 30° and 90°.

4. A compressor according to claim 2, wherein the inclination of the rear wall relative to the casing longitudinal axis differs from the inclination of the front wall relative to the casing longitudinal axis.

5. A compressor according to claim 1, wherein the guide vanes are inclined in the radial direction at an angle between 10° and 90°.

6. A compressor according to claim 5, wherein the inclination of the guide vanes relative to the radial direction varies along the height and/or the length of these vanes.

7. A compressor according to claim 1, wherein the ratio between the guide vane radial projection height and the radial depth of the annular recess is less than 1.0.

8. A compressor according to claim 7, wherein the ratio between the guide vane radial projection height and the radial depth of the annular recess varies along the axial length of the guide vanes.

9. A compressor according to claim 1, wherein the ratio between the volume of the guide vanes and the total volume of the annular recess is greater than 0.5.

10. A compressor according to claim 1, wherein the ratio between the cross-sectional width of each of the curved channels between adjacent guide vanes and the cross-sectional pitch of the guide vanes is between 0.3 and 1.0.

11. A compressor according to claim 10, wherein the ratio between the cross-sectional width of each of the curved channels between adjacent guide vanes and the cross-sectional pitch of the guide vanes varies along the radial projection height and/or the axial length of the guide vanes.

12. A compressor according to claim 1, wherein the ratio between the vane radial projection height and the overall axial width of the annular recess is between 0.2 and 1.0.

13. A compressor according to claim 1, wherein the axial midpoint of the annular recess lies upstream of the rotor blade axial chord midpoint in the blade tip region.

14. A compressor according to claim 1, wherein the ratio between the axial width of the annular recess and the rotor blade axial chord is between 0.4 and 1.0.

15. A compressor according to claim 1, which comprises a single-stage compressor.

16. A compressor according to claim 1, which comprises a multi-stage compressor.

17. A compressor including:

a casing which defines a generally cylindrical flow passage; a rotor carrying at least one set of rotor blades; and casing treatment including:

an annular recess in the casing for removing low momentum flow adjacent the tips of the rotor blades, in use, and returning the flow to the generally cylindrical flow passage upstream of the point of removal; and a plurality of curved guide vanes located within the annular recess so as to define an annular inlet downstream of the vanes and/or an annular outlet upstream of the vanes, each guide vane projecting radially inwardly from the casing towards a free end which is exposed at or near the mouth of the recess to define a series of curved channels within the recess adjacent the annular inlet and/or the annular outlet.

18. A compressor according to claim 17, wherein a rear wall of the annular recess and a front wall of this recess are inclined at an angle relative to the longitudinal axis of the casing.

19. A compressor according to claim 18, wherein the angle of inclination of the rear wall and the front wall relative to the longitudinal axis of the casing is between 30° and 90°.

20. A compressor according to claim 18, wherein the inclination of the rear wall relative to the casing longitudinal axis differs from the inclination of the front wall relative to the casing longitudinal axis.

21. A compressor according to claim 17, wherein the guide vanes are inclined in the radial direction at an angle between 10° and 90°.

22. A compressor according to claim 21, wherein the inclination of the guide vanes relative to the radial direction varies along the height and/or the length of these vanes.

23. A compressor according to claim 17, wherein the ratio between the guide vane radial projection height and the radial depth of the annular recess is less than 1.0.

24. A compressor according to claim 23, wherein the ratio between the guide vane radial projection height and the radial depth of the annular recess varies along the axial length of the guide vanes.

25. A compressor according to claim 17, wherein the ratio between the volume of the guide vanes and the total volume of the annular recess is greater than 0.5.

26. A compressor according to claim 17, wherein the ratio between the cross-sectional width of each of the curved channels between adjacent guide vanes and the cross-sectional pitch of the guide vanes is between 0.3 and 1.0.

27. A compressor according to claim 26, wherein the ratio between the cross-sectional width of each of the curved channels between adjacent guide vanes and the cross-sectional pitch of the guide vanes varies along the radial projection height and/or the axial length of the guide vanes.

28. A compressor according to claim 17, wherein the ratio between the vane radial projection height and the overall axial width of the annular recess is between 0.2 and 1.0.

29. A compressor according to claim 17, wherein the axial midpoint of the annular recess lies upstream of the rotor blade axial chord midpoint in the blade tip region.

30. A compressor according to claim 17, wherein the ratio between the axial width of the annular recess and the rotor blade axial chord is between 0.4 and 1.0.

31. A compressor including:

a casing which defines a generally cylindrical flow passage; a rotor carrying at least one set of rotor blades;

at least one set of stator blades; and hub treatment including:

an annular recess in a hub of the rotor adjacent the stator blades; and a plurality of curved guide vanes located within the annular recess so as to define an annular inlet downstream of the vanes and/or an annular outlet upstream of the vanes, each guide vane projecting radially outwardly from the rotor hub towards a free end which is exposed at or near the mouth of the recess to define a series of curved channels within the recess adjacent the annular inlet and/or the annular outlet.

32. A compressor according to claim 31, wherein a rear wall of the annular recess and a front wall of this recess are inclined at an angle relative to the longitudinal axis of the casing.

33. A compressor according to claim 32, wherein the angle of inclination of the rear wall and the front wall relative to the longitudinal axis of the casing is between 30° and 90°.

34. A compressor according to claim 32, wherein the inclination of the rear wall relative to the casing longitudinal axis differs from the inclination of the front wall relative to the casing longitudinal axis.

35. A compressor according to claim 31, wherein the guide vanes are inclined in the radial direction at an angle between 10° and 90°.

36. A compressor according to claim 35, wherein the inclination of the guide vanes relative to the radial direction varies along the height and/or the length of these vanes.

37. A compressor according to claim 31, wherein the ratio between the guide vane radial projection height and the radial depth of the annular recess is less than 1.0.

38. A compressor according to claim 37, wherein the ratio between the guide vane radial projection height and the radial depth of the annular recess varies along the axial length of the guide vanes.

39. A compressor according to claim 31, wherein the ratio between the volume of the guide vanes and the total volume of the annular recess is greater than 0.5.

40. A compressor according to claim 31, wherein the ratio between the cross-sectional width of each of the curved channels between adjacent guide vanes and the cross-sectional pitch of the guide vanes is between 0.3 and 1.0.

41. A compressor according to claim 40, wherein the ratio between the cross-sectional width of each of the curved channels between adjacent guide vanes and the cross-sectional pitch of the guide vanes varies along the radial projection height and/or the axial length of the guide vanes.

42. A compressor according to claim 31, wherein the ratio between the vane radial projection height and the overall axial width of the annular recess is between 0.2 and 1.0.

43. A compressor according to claim 31, which comprises a single-stage compressor.

44. A compressor according to claim 31, which comprises a multi-stage compressor.

45. A casing insert for a compressor of the type including a casing which defines a generally cylindrical flow passage, a rotor carrying at least one set of rotor blades, and at least one set of stator blades, the casing insert being connectable to the compressor casing adjacent the rotor blades and defining casing treatment which includes:

an annular recess for removing low momentum flow adjacent the tips of the rotor blades, in use, and returning the flow to the generally cylindrical flow passage upstream of the point of removal; and a plurality of curved guide vanes located within the annular recess so as to define an annular inlet downstream of the vanes and/or an annular outlet upstream of the vanes, each guide vane projecting radially inwardly from the casing insert towards a free end which is exposed at or near the mouth of the recess to define a series of curved channels within the recess adjacent the annular inlet and/or the annular outlet.

46. A casing insert according to claim 45, wherein a rear wall of the annular recess and a front wall of this recess are inclined at an angle relative to the longitudinal axis of the casing.

47. A casing insert according to claim 46, wherein the angle of inclination of the rear wall and the front wall relative to the longitudinal axis of the casing is between 30° and 90°.

48. A casing insert according to claim 46, wherein the inclination of the rear wall relative to the casing longitudinal axis differs from the inclination of the front wall relative to the casing longitudinal axis.

49. A casing insert according to claim 45, wherein the guide vanes are inclined in the radial direction at an angle between 10° and 90°.

50. A casing insert according to claim 49, wherein the inclination of the guide vanes relative to the radial direction varies along the height and/or the length of these vanes.

51. A casing insert according to claim 45, wherein the ratio between the guide vane radial projection height and the radial depth of the annular recess is less than 1.0.

52. A casing insert according to claim 51, wherein the ratio between the guide vane radial projection height and the radial depth of the annular recess varies along the axial length of the guide vanes.

53. A casing insert according to claim 45, wherein the ratio between the volume of the guide vanes and the total volume of the annular recess is greater than 0.5.

54. A casing insert according to claim 45, wherein the ratio between the cross-sectional width of each of the curved channels between adjacent guide vanes and the cross-sectional pitch of the guide vanes is between 0.3 and 1.0.

55. A casing insert according to claim 54, wherein the ratio between the cross-sectional width of each of the curved channels between adjacent guide vanes and the cross-sectional pitch of the guide vanes varies along the radial projection height and/or the axial length of the guide vanes.

56. A casing insert according to claim 45, wherein the ratio between the vane radial projection height and the overall axial width of the annular recess is between 0.2 and 1.0.

57. A casing insert for a compressor of the type including a casing which defines a generally cylindrical flow passage, and a rotor carrying at least one set of rotor blades, the casing insert being connectable to the compressor casing adjacent the rotor blades and defining casing treatment which includes:

an annular recess for removing low momentum flow adjacent the tips of the rotor blades, in use, and returning the flow to the generally cylindrical flow passage upstream of the point of removal; and a plurality of curved guide vanes located within the annular recess so as to define an annular inlet downstream of the vanes and/or an annular outlet upstream of the vanes, each guide vane projecting radially inwardly from the casing insert towards a free end which is exposed at or near the mouth of the recess to define a series of curved channels within the recess adjacent the annular inlet and/or the annular outlet.

58. A casing insert according to claim 57, wherein a rear wall of the annular recess and a front wall of this recess are inclined at an angle relative to the longitudinal axis of the casing.

59. A casing insert according to claim 58, wherein the angle of inclination of the rear wall and the front wall relative to the longitudinal axis of the casing is between 30° and 90°.

60. A casing insert according to claim 58, wherein the inclination of the rear wall relative to the casing longitudinal axis differs from the inclination of the front wall relative to the casing longitudinal axis.

61. A casing insert according to claim 57, wherein the guide vanes are inclined in the radial direction at an angle between 10° and 90°.

62. A casing insert according to claim 61, wherein the inclination of the guide vanes relative to the radial direction varies along the height and/or the length of these vanes.

63. A casing insert according to claim 57, wherein the ratio between the guide vane radial projection height and the radial depth of the annular recess is less than 1.0.

64. A casing insert according to claim 63, wherein the ratio between the guide vane radial projection height and the radial depth of the annular recess varies along the axial length of the guide vanes.

65. A casing insert according to claim 57, wherein the ratio between the volume of the guide vanes and the total volume of the annular recess is greater than 0.5.

66. A casing insert according to claim 57, wherein the ratio between the cross-sectional width of each of the curved channels between adjacent guide vanes and the cross-sectional pitch of the guide vanes is between 0.3 and 1.0.

67. A casing insert according to claim 66, wherein the ratio between the cross-sectional width of each of the curved channels between adjacent guide vanes and the cross-sectional pitch of the guide vanes varies along the radial projection height and/or the axial length of the guide vanes.

68. A casing insert according to claim 57, wherein the ratio between the vane radial projection height and the overall axial width of the annular recess is between 0.2 and 1.0.

* * * * *

UNITED STATES PATENT AND TRADEMARK OFFICE

CERTIFICATE OF CORRECTION

PATENT NO. : 7,575,412 B2
APPLICATION NO. : 10/505971
DATED : August 18, 2009
INVENTOR(S) : Peter Seitz It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 811 days.

Signed and Sealed this

Seventh Day of September, 2010

David J. Kappos

David J. Kappos
*Director of the United States Patent and Trademark Office*